US005796800A

United States Patent [19]

Hafezan et al.

[11] Patent Number: 5,796,800

[45] Date of Patent: Aug. 18, 1998

[54] COUNTING ROTOR ASSEMBLIES

[75] Inventors: Siavosh Hafezan; Martin Gordon Snook, both of Colchester, Great Britain

[73] Assignee: Pelcombe Limited, United Kingdom

[21] Appl. No.: 750,727

[22] PCT Filed: Jun. 9, 1995

[86] PCT No.: PCT/GB95/01356

§ 371 Date: Dec. 13, 1996

§ 102(e) Date: Dec. 13, 1996

[87] PCT Pub. No.: WO95/34875

PCT Pub. Date: Dec. 21, 1995

[30] Foreign Application Priority Data

Jun. 16, 1994 [GB] United Kingdom ..... 9412104

[51] Int. Cl.[6] ..... G06M 7/00

[52] U.S. Cl. ..... 377/8

[58] Field of Search ..... 377/8

[56] References Cited

U.S. PATENT DOCUMENTS 5,324,921 6/1994 Takarada et al. ..... 377/8

5,612,984 3/1997 Fuller et al. ..... 377/8

*Primary Examiner*—Margaret Rose Wambach

*Attorney, Agent, or Firm*—Andrus, Sceales, Starke & Sawall

[57] ABSTRACT

A rotor assembly for counting sheets in a stack has a support on which is rotatably mounted a rotor such that the rotor engages an edge region of the stack. The rotor has a plurality of helical transfer grooves through which sheets are transferred one at a time from one side of the rotor to the other. A foot bears on the rotor and has a port which, as the rotor rotates, comes into and out of communication with further ports on the rotor each leading to a respective groove, whereby air is drawn in a timed relationship through the rotor to assist the transfer of sheets through the helical grooves. The rotor is movable axially with respect to its support and there is a detector arranged to detect the position of the foot with respect to the support thereby to give an output indicative of the position of the rotor with respect to the support.

16 Claims, 4 Drawing Sheets

21
47
47
56
48
60
31
38
37
36
34
35
18
49
21
40
22
12
48

COUNTING ROTOR ASSEMBLIES

This invention concerns the counting of sheets, for example of paper, assembled into a stack. In particular, this invention relates to a rotor assembly for use in a counting head of a sheet counter.

A known form of counting apparatus employs a rotor arranged to count the number of sheets in a stack by engaging an edge region of the stack and then, on rotation of the rotor, separating an edge portion of each sheet in turn from the stack and transferring the separated edge portion through a transfer groove to the other side of the rotor. At least one suction port may be provided in the rotor adjacent the transfer groove and through which port air is drawn in a timed relationship to rotor rotation, to assist the separation from the stack of the next sheet edge portion to be counted.

A known technique for drawing air through the suction port in a timed relationship to the rotor rotation is to provide a passageway in the rotor from the suction port to an inlet port in an external surface of the rotor. A static foot bears on that surface of the rotor and has a further port which comes into and out of registration with the inlet port, as the rotor rotates. The further port is connected to a low-pressure source and so each time the inlet port in the rotor comes into registration with the further port of the foot, air is drawn through the suction port of the rotor. By appropriately positioning the foot in the circumferential direction of the rotor, suction may be provided at the suction port at the appropriate time to assist the separation of the edge portion of the next sheet to be counted, and the guiding of that edge portion into the transfer groove of the rotor.

As counting commences and sheet edge portions are transferred from one side of the rotor to the other, the rotor has to move along the length of the stack. In a known form of such counter, the rotor is mounted on a carriage arranged for vertical sliding movement along the height of the stack and which carriage is counter-balanced so that the rotor exerts, under gravity, a relatively small force on the stack. Then, the rotor may be allowed to move along the length of the stack merely by being pushed by the sheets of the stack, as the sheets are transferred from one side of the rotor to the other.

It is also known to mount the rotor for limited axial movement on a carriage, there being two limit switches at the permitted extremes of rotor movement with respect to the carriage and a motor drive arrangement to move the carriage when the rotor triggers one limit switch, motor operation being suspended when the rotor triggers the other limit switch. Such motor control gives a varying engagement force between the rotor and the sheets being counted, and in turn this may lead to a lack of reliability in the counting operation.

In our International Patent Publication No. WO 95/00927, we have described and claimed an improved control system which feeds the rotor smoothly and more or less continuously along the stack, to ensure that the force exerted by the counting head on each sheet of the stack is substantially constant. In turn, this significantly enhances counting reliability. The present invention aims at providing an improved foot arrangement for a counting rotor of the kind described above, to enable yet better control of the rotor position in the stack and to enhance even more the counting reliability achieved with a control arrangement as described in our said International Publication.

According to one aspect of the present invention, there is provided a rotor assembly for counting sheets in a stack thereof and comprising a support, a rotor rotatably mounted on the support to engage an edge region of the stack and arranged upon rotation to transfer an edge portion of each sheet in turn through a transfer groove to the other side of the rotor, there being at least one suction port in the rotor through which air is drawn in a timed relationship to the rotation of the rotor to assist in the separation of the sheet edge portions, the suction port communicating with an inlet port on a external surface of the rotor, and a foot mounted on the support to bear on said external surface of the rotor and having a further port through which air may be drawn and which comes into and out of registration with the inlet port upon rotation of the rotor, the rotor being movable axially with respect to the support and there being detection means to detect the position of the foot with respect to the support thereby to give an output indicative of the position of the rotor with respect to the support.

In the present invention, the foot serves the combined purpose of connecting a low-pressure source to the suction port of the rotor, in a timed relationship to rotor rotation, and of allowing the detection of rotor movement in the axial direction of the rotor, as counting continues. By then providing an output indicative of the rotor position to the control system, the latter may control carriage movement to ensure that the rotor position relative to the carriage varies only slightly, and is controlled smoothly.

Most preferably, the rotor is spring-urged to move towards the foot and the foot is spring-urged in the opposite direction, the rotor being substantially balanced between the respective spring forces. Advantageously, the rotor is non-rotatably but axially movably mounted on its supporting shaft, for example by means of a linear bearing, though it would be possible for the rotor to be secured to its shaft and for the shaft to be movable axially with respect to the support. Either way, by substantially balancing the rotor between said spring forces, the force exerted on sheets in the stack as counting continues may be minimised.

In a preferred embodiment of the invention, the foot is disposed on an end of a plunger which is slidably mounted with respect to the support and is urged towards the rotor. In order to accommodate minor non-uniformity in the overall system, the connection between the foot and the plunger may allow the foot universally to pivot with respect to the plunger.

Preferably, there is provided a housing mounted on the support and within which the plunger is slidably mounted. In this case, a position detector for the plunger may be mounted on the housing, so that the position of the foot is indirectly sensed, by virtue of the connection between the foot and plunger, and in turn the position of the rotor is itself indirectly sensed.

The means mounting the foot on the plunger (such as the housing referred to above) may be adjustable in the circumferential direction of the rotor, to permit adjustment of the suction timing through the suction port.

Though the counting of sheets transferred through the transfer groove may be performed in any known manner, such as by using an optical sensor, the arrangement of the present invention allows the counting to be performed by sensing the pressure prevailing in the passageways within the rotor and leading to the suction port therein, a count signal being produced dependent upon the sensed pressure. This may be achieved by providing in the foot at least one sensing port which comes into and out of registration with a pressure port on the rotor, the pressure at that pressure port depending upon the transfer (or otherwise) of a sheet when suction is applied to the suction port. An appropriate pressure transducer may then be connected either directly, or indirectly, to the sensing port of the foot.

In our International Patent Publication No. WO 95/00926, we have described and claimed a rotor for counting the number of sheets in a stack, and which may be used in a rotor assembly of the present invention. That rotor includes a further port adjacent the transfer groove but on the opposite side of that groove to the suction port, whereby should two adjacent sheet edge portions be simultaneously separated together from the stack and be lifted by said suction port, suction through the further port will lift the edge portion of the second sheet away from the sheet to be counted, to guide said second sheet edge portion away from the transfer groove for counting on a subsequent count cycle.

When a rotor as described just above is employed in a rotor assembly of the present invention, the foot may connect the low-pressure source to the further port of the rotor, in the same way as the foot connects that source to the transfer port of the rotor. In addition, the rotor may include a pressure port for said further port and the foot may include a sensing port to communicate with this pressure port, whereby a count signal may be obtained for the number of double sheet feeds where the second fed sheet is then separated and returned to the stack for counting on the next count cycle.

This invention extends to a rotor assembly of the kind described above, wherein the rotor is spring-urged to move towards the foot and the foot is spring-urged in the opposite sense, whereby the rotor is substantially balanced between the respective spring forces.

By way of example only, one specific embodiment of the present invention will now be described in detail, reference being made to the accompanying drawings, in which:

FIG. 1 diagrammatically illustrates the principle of a sheet counter with which the present invention is concerned;

FIG. 2 diagrammatically illustrates a counting rotor together with a carriage therefor, arranged for use with a foot in accordance with the present invention;

Figure 1:
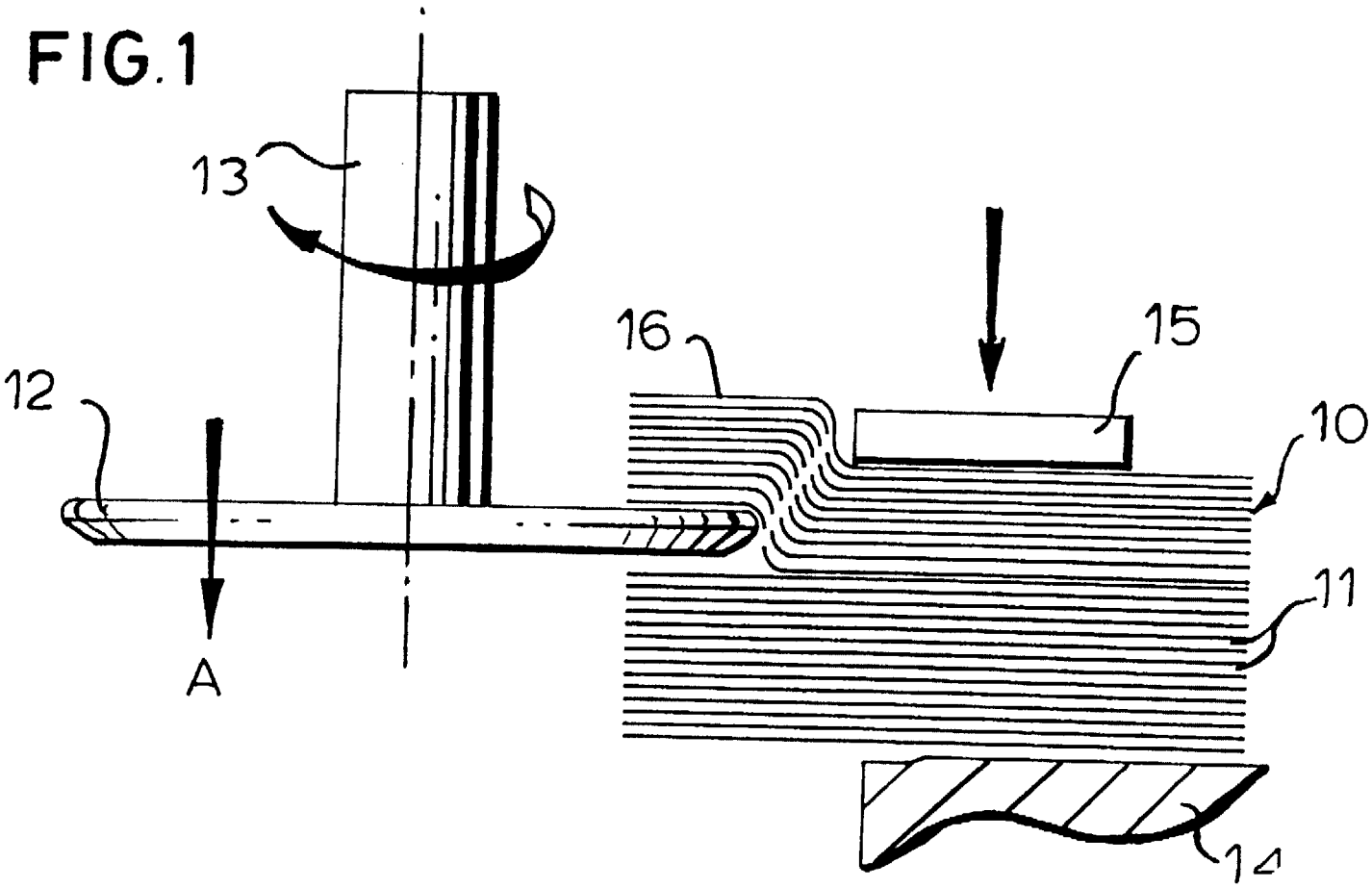

FIG. 1 illustrates a part of a stack 10 of sheets 11 to be counted by means of a counting rotor 12 of a known construction, which rotor forms no part of the present invention and will therefore not be described in further detail here. The rotor may take the form of that counting rotor described in our International Patent Publication No. WO 95/00926. The rotor 12 is mounted on a shaft 13 which is supported on a vertically-movable carriage (not shown) so that the rotor may be advanced in the direction of arrow A, along the height of the stack as counting progresses.

The sheets 11 in the stack 10 are clamped to a table 14 by means of a clamping pad 15 arranged to bear down on the top sheet 16 of the stack 10. Any suitable means for urging the pad 15 into engagement with the stack so as to exert a required pre-determined force on the stack may be employed. For example, the pad 15 may be mounted on and driven by a pneumatic ram, or on a lead screw driven by a motor, or by spring means.

In use, both the rotor 12 and the clamping pad 15 are lifted clear of the support table 14 so that a stack 10 of sheets may be assembled thereon. Both the rotor 12 and clamping pad 15 are then advanced to engage the top sheet of the stack, the pad being urged to engage the top sheet with a pre-determined clamping force. Rotation of the rotor 12 may then commence, to transfer sheets to the other side of the rotor, the rotor being advanced in the direction of arrow A, as counting progresses.

Figure 2:
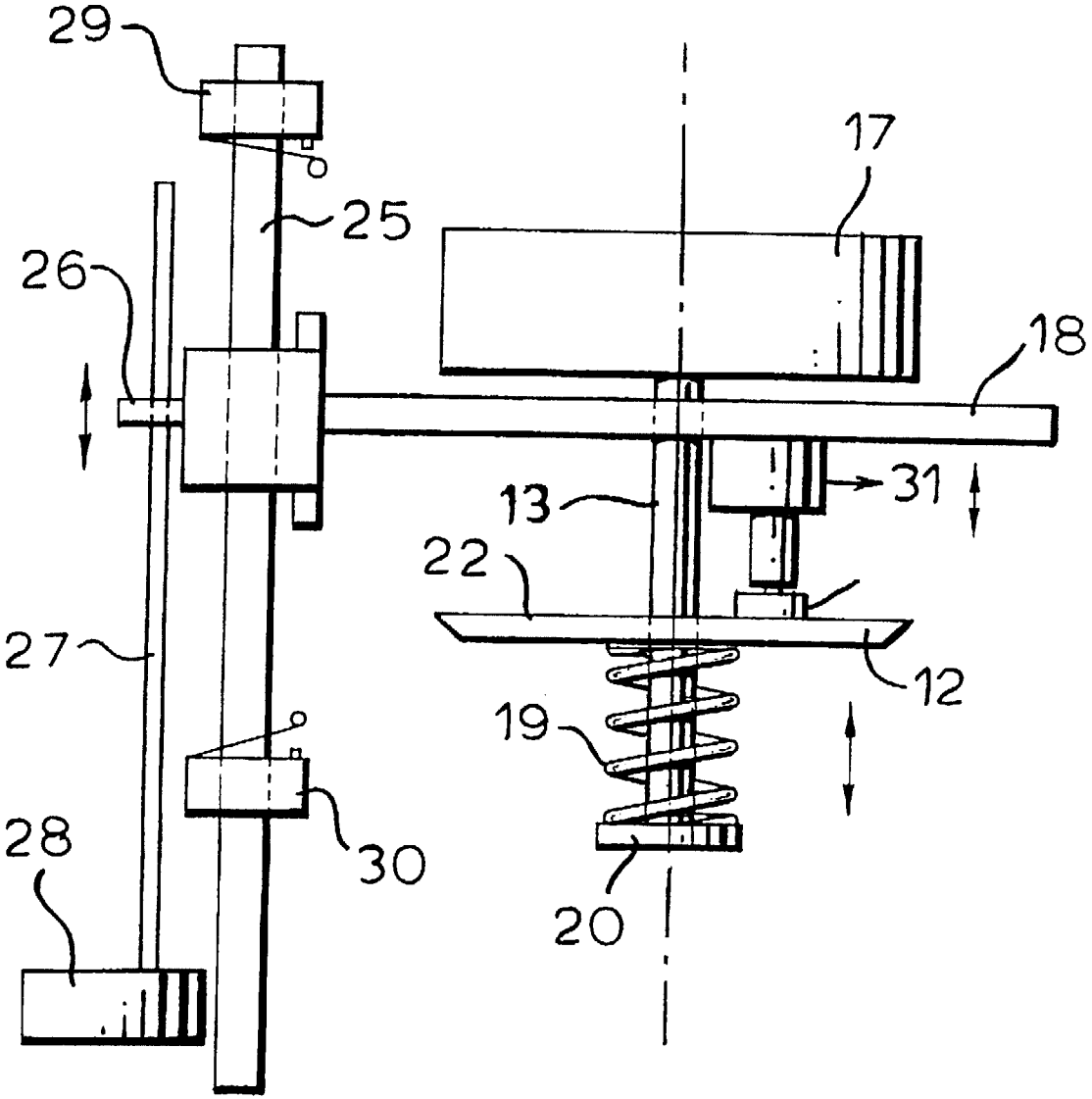

Vertical movement of the rotor 12 along a stack of sheets to be counted is effected by the arrangement illustrated in FIG. 2. The rotor 12 is mounted by means of a non-rotatable linear bearing (not shown) on shaft 13 which is driven by a motor 17 mounted on a vertically-slidable carriage 18. A spring 19 acts between the rotor 12 and a flange 20 at the free end of the shaft 13, to urge the rotor 12 upwardly. A foot 21 is supported on the carriage 18 and is spring-urged downwardly to bear on the upper surface 22 of the rotor 12.

The carriage 18 is mounted on a pair of parallel guides 25 (only one of which is visible in FIG. 2) for vertical sliding movement. The carriage includes a nut 26 threaded on a lead screw 27 driven by a motor 28, whereby the vertical position of the carriage 18 may be adjusted as required, by driving the motor 28. Alternatively, a motor and toothed belt or other non-slip drive arrangement could be employed to effect movement of the carriage. Limit switches 29 and 30 for the carriage are provided at each end of the guides 25.

The operation of the motor 28 is controlled dependent upon the instantaneous position of the rotor 12, on its shaft 13. This is sensed by a transducer associated with the foot 21 and providing an electrical output 31, as will be described below.

Figures 3, 5:
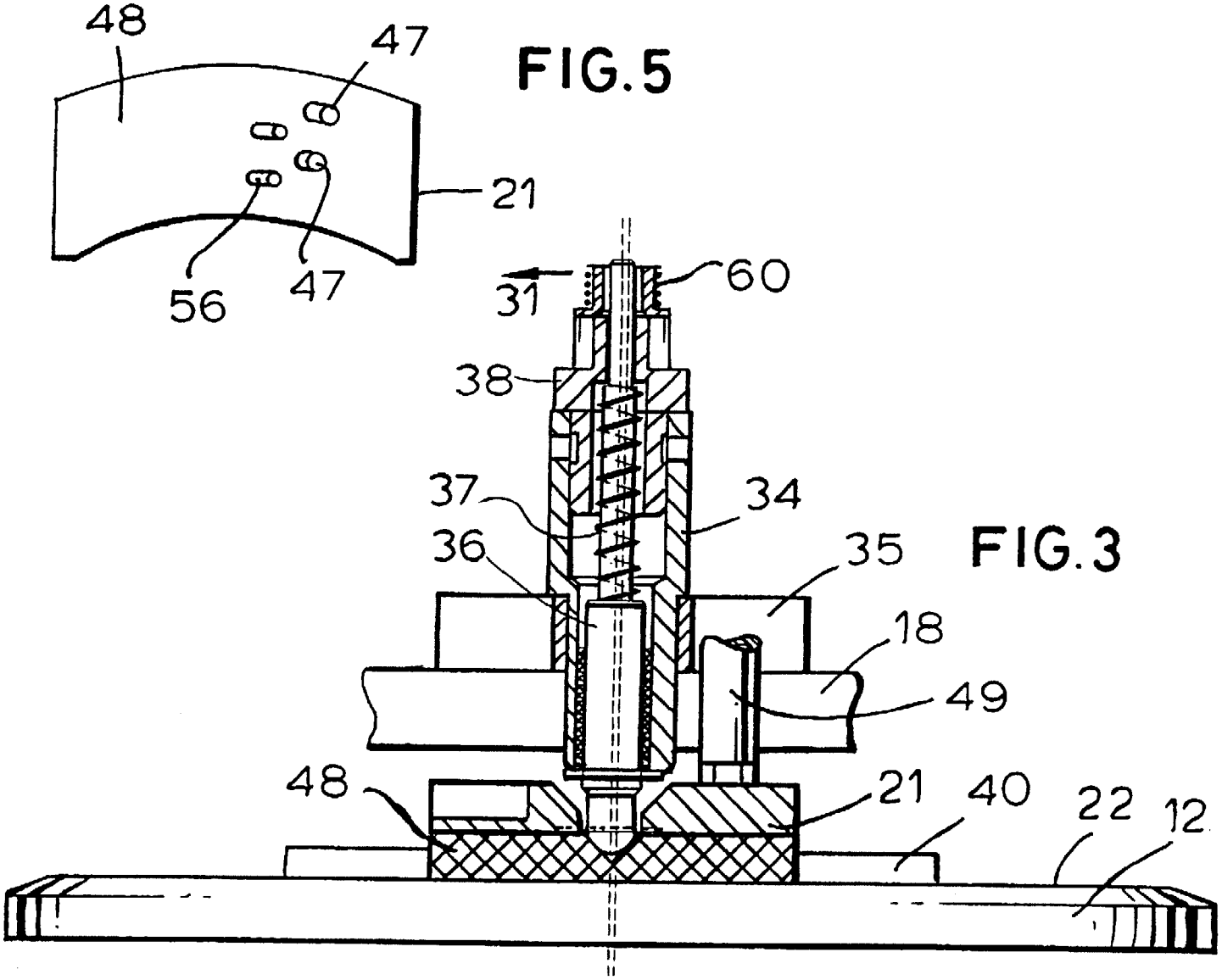
FIG. 3 is a sectional view through a foot assembly for the rotor of FIG. 2, taken on line B—B marked on FIG. 4.
FIG. 5 is a under-plan view on the foot of the foot assembly.
Figure 4:
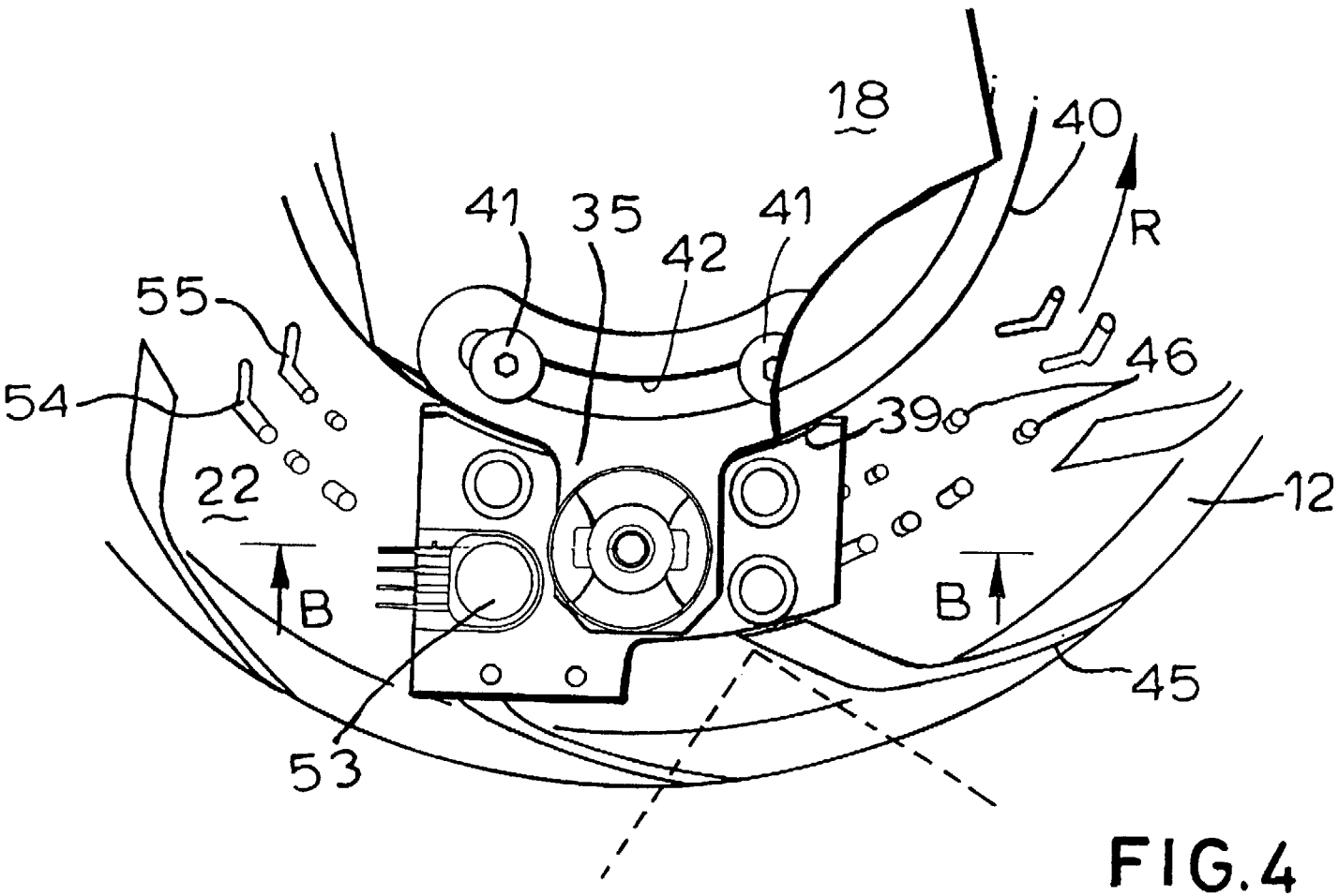
FIG. 4 is a plan view on the foot assembly and rotor of FIG. 3.

Referring now to FIGS. 3 to 5, there is shown in more detail the foot assembly associated with the rotor 12. A cylindrical housing 34 is fitted into an aperture in a support 35 attached to the carriage 18 and a plunger 36 is slidably mounted within the housing. A compression spring 37 surrounds the plunger 36 and acts between that plunger and an end cap 38 for the housing 34, whereby the plunger 36 is urged downwardly towards rotor 12.

The lower end of the plunger 36 has a rounded profile and is received in a conical recess in foot 21, so that the foot may universally pivot and rotate about the plunger 36. The radially inner edge 39 of the foot 21 has an arcuate profile and slidingly engages a circular shoulder 40 formed on the rotor 12, whereby the foot is held against rotation about the plunger 36. The bore of the housing 34 within which the plunger 36 slides is eccentric with respect to the housing outer surface, whereby rotation of the housing within the aperture in the support 35 allows adjustment of the foot 21 in the radial direction, to optimise the sliding engagement of the foot with the shoulder 40. In addition, bolts 41 attach the support 35 to the carriage 18 which bolts pass through an arcuate slot 42 in the support, whereby the circumferential position of the foot with respect to the rotor may be adjusted. In the above manner, the foot may properly be located in the required position, with respect to the rotor 12 and yet may universally pivot about the end of the plunger 36, to accommodate minor variations in the rotor surface.

The rotor itself forms no part of the present invention and reference should be made to our International Patent Publication No. WO 95/00926 for a full description of one possible design of such a rotor. That rotor has a number of generally helical transfer grooves 45 arranged around its periphery and leading from the upper surface 22, to the lower surface of the rotor. At least one suction port is disposed in the vicinity of each transfer groove, whereby the separation of the next sheet to be counted from a stack thereof may be assisted by air drawn through that suction port in a timed relationship to rotor rotation. Internal passageways in the rotor connect each suction port to a respective inlet port 46 formed in the upper surface 22 of the rotor 12 over which the foot 21 sweeps. The lower surface of the foot (FIG. 5) has ports 47 disposed therein, which ports come into and out of registration with the inlet ports of the rotor as the rotor rotates in the direction of arrow R, thereby to connect to the rotor a source of low-pressure.

The ports 47 in the foot are formed in a wear plate 48, made from a material which minimises friction with and wear of the rotor 12. Those ports communicate through passageways in the foot to the upper surface thereof, to which is connected a flexible pipe 49 leading to the low-pressure source.

Also provided on the upper surface of the foot is a pressure transducer 53 (omitted for clarity in FIG. 3) and which senses the pressure for the time being prevailing at a pressure port 54 in the rotor as that port passes under the foot 21. Each pressure port 54 internally communicates with an associated rotor suction port, there being one pressure port for each transfer groove 45 of the rotor. Appropriate analysis of the pressures sensed by the transducer 53 allows the generation of a count signal, each time a sheet is separated from the stack and transferred to the other side of the rotor, through a transfer groove.

The rotor described in our International Patent Publication No. WO 95/00926 also includes a reject slot together with a further suction port, to reject a second sheet back to the stack of uncounted sheets, in the event that two sheets are lifted away from the stack simultaneously. In a similar manner to that described above, a count may be generated of the number of rejected second sheets by sensing the pressure at a second pressure port 55 passing under the foot 21 and associated with a further suction port of the rotor adjacent a reject slot. A transducer for this purpose is not shown in the drawings but would connect to port 56 on the upper surface of the foot.

An inductive position-sensing coil 60 is mounted on the end cap 38 of the housing 34, so as to sense the position of the plunger 36, within that housing. The output 31 from the coil 60 is used to control the motor 28, via a suitable control system which preferably operates linearly in order smoothly and continuously to drive the carriage 18 along guides 25, as a counting operation proceeds. In this way, the position of the rotor 12 may vary from its static position only relatively slightly, and will not impart any sudden load variations on the sheets being counted.

In use, the rotor 12 is substantially balanced between springs 19 and 37, by virtue of the action of the foot 21. The position of the plunger 36 is used indirectly to sense the rotor position on its shaft and the foot is adjustable so as to be accurately located precisely in the required position, with respect to the rotor position, in order to ensure an optimised counting function.

We claim:

1. A rotor assembly for counting sheets (11) in a stack (10) thereof and comprising a support (18), a rotor (12) rotatably mounted on the support to engage an edge region of the stack (10) and arranged upon rotation to transfer an edge portion of each sheet (11) in turn through a transfer groove (45) to the other side of the rotor (12), there being at least one suction port in the rotor (12) through which air is drawn in a timed relationship to the rotation of the rotor to assist in the separation of the sheet edge portions, the suction port being connected through the rotor to an inlet port (46) on an external surface (22) of the rotor, and a foot (21) mounted on the support (18) to bear on said external surface of the rotor and having a further port (47) which comes into and out of registration with the inlet port (46) upon rotation of the rotor, so that suction applied to the further port (47) is connected in said timed relationship to the suction port of the rotor (12), characterised in that the rotor (12) is movable axially with respect to the support (18) and detection means (36,60) are provided to detect the position of the foot (21) with respect to the support (18) thereby to give an output indicative of the position of the rotor (12) with respect to the support (18).

2. A rotor assembly as claimed in claim 1, wherein the rotor (12) is spring-urged (19) to move towards the foot (21), and the foot (21) is spring-urged (37) in the opposite direction, the rotor (12) being substantially balanced between the respective spring forces.

3. A rotor assembly as claimed in claim 1, wherein the rotor (12) defines a circular shoulder (40) adjacent said external surface (22) and the foot (21) is profiled to locate against the shoulder (40).

4. A rotor assembly as claimed in claim 1, wherein the foot (21) includes at least one sensing port (54) which comes into and out of registration with a pressure port (56) on the rotor (12) the pressure at which pressure port (56) depends upon the transfer of a sheet (11), and the foot (21) carries a pressure transducer (53) communicating with the sensing port (54) whereby the transducer may yield a count signal dependent upon the sensed pressure.

5. A rotor assembly as claimed in claim 1, wherein said external surface of the rotor is substantially radial and the foot is mounted for movement in a direction generally parallel to the rotational axis of the rotor.

6. A rotor assembly as claimed in claim 1, wherein the foot is disposed on an end of a plunger which is slidably mounted with respect to the support and is urged towards the rotor.

7. A rotor assembly as claimed in claim 6, wherein said detection means is arranged to sense the position of the plunger with respect to the support.

8. A rotor assembly for counting sheets (11) in a stack (10) thereof and comprising a support (18), a rotor (12) rotatably mounted on the support to engage an edge region of the stack (10) and arranged upon rotation to transfer an edge portion of each sheet (11) in turn through a transfer groove (45) to the other side of the rotor (12), there being at least one suction port in the rotor (12) through which air is drawn in a timed relationship to the rotation of the rotor to assist in the separation of the sheet edge portions, the suction port being connected through the rotor to an inlet port (46) on an external surface (22) of the rotor, and a foot (21) mounted on the support (18) to bear on said external surface of the rotor and having a further port (47) which comes into and out of registration with the inlet port (46) upon rotation of the rotor, so that suction applied to the further port (47) is connected in said timed relationship to the suction port of the rotor (12), characterised in that the rotor (12) is spring-urged (19) to move towards the foot (21), and the foot (21) is spring-urged (37) in the opposite direction, the rotor being substantially balanced between the respective spring forces.

9. A rotor assembly as claimed in claim 8, wherein said external surface (22) of the rotor (12) is substantially radial and the foot (21) is mounted for movement in a direction generally parallel to the rotational axis of the rotor (12).

10. A rotor assembly as claimed in claim 8, wherein the foot (21) is disposed on an end of a plunger (36) which is slidably mounted with respect to the support (18) and is urged towards the rotor (12).

11. A rotor assembly as claimed in claim 10, wherein the connection between the foot (21) and the plunger (36) allows the foot universally to pivot with respect to the plunger.

12. A rotor assembly as claimed in claim 10 wherein detection means (60) is arranged to sense the position of the plunger (36) with respect to the support (18).

13. A rotor assembly as claimed in claim 10, wherein there is provided a housing (34) mounted on the support (18) and within which the plunger (36) is slidably mounted, a position detector (60) for the plunger being mounted on the housing (34,38).

14. A rotor assembly as claimed in claim 13, wherein the position of the housing (34) with respect to the radial direction of the rotor (12) is adjustable.

15. A rotor assembly as claimed in claim 14, wherein the housing (34) is cylindrical and the axis of the plunger (36) is eccentric with respect to the housing axis, the housing (34) being rotatable relative to the support in order to effect adjustment of the radial position of the plunger.

16. A rotor assembly as claimed in claim 14, wherein the means (41,42) mounting the housing (34) on the support (18) are adjustable in the circumferential direction of the rotor (12) to permit adjustment of the suction timing through the suction port.

* * * * *